US012180020B2

(12) United States Patent
Maruyama

(10) Patent No.: US 12,180,020 B2
(45) Date of Patent: Dec. 31, 2024

(54) IMAGE PROCESSING APPARATUS

(71) Applicant: TOSHIBA TEC KABUSHIKI KAISHA, Tokyo (JP)

(72) Inventor: Shinji Maruyama, Izunokuni Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 157 days.

(21) Appl. No.: 17/899,782

(22) Filed: Aug. 31, 2022

(65) Prior Publication Data

US 2024/0067470 A1 Feb. 29, 2024

(51) Int. Cl.
*B65H 1/26* (2006.01)

(52) U.S. Cl.
CPC ..... *B65H 1/266* (2013.01); *B65H 2405/121* (2013.01); *B65H 2405/31* (2013.01); *B65H 2801/06* (2013.01)

(58) Field of Classification Search
CPC . B65H 1/04; B65H 1/26; B65H 1/266; B65H 2405/12; B65H 2405/121; B65H 2405/31
See application file for complete search history.

(56) References Cited

U.S. PATENT DOCUMENTS

2006/0202406 A1* 9/2006 Kobayashi ..... G03G 15/6502 271/162
2008/0117482 A1* 5/2008 Kusumi ..... H04N 1/00525 358/498
2013/0285317 A1* 10/2013 Ishikura ..... B65H 9/08 271/241
2021/0070571 A1* 3/2021 Oshida ..... B65H 1/04

FOREIGN PATENT DOCUMENTS

JP 8-81071 3/1996
JP 9-222756 8/1997
JP 2016098056 A * 5/2016 ..... B65H 1/266

* cited by examiner

*Primary Examiner* — Prasad V Gokhale
(74) *Attorney, Agent, or Firm* — Amin, Turocy & Watson, LLP

(57) ABSTRACT

An image processing apparatus in an embodiment includes an apparatus main body, a paper feeding cassette, a drawing-in mechanism, and a restricting member. The paper feeding cassette is inserted into the apparatus main body to be capable of being drawn out in a first orientation along a first direction. The drawing-in mechanism draws the paper feeding cassette into the apparatus main body up to a drawing-in completion position along a second orientation. The restricting member restricts the paper feeding cassette present in the drawing-in completion position from being displaced in the second orientation. If the paper feeding cassette is not connected to the drawing-in mechanism even if the paper feeding cassette is pushed in up to the drawing-in completion position, the restricting member is displaced from the predetermined position to allow the paper feeding cassette to be displaced in the second orientation with respect to the apparatus main body.

8 Claims, 15 Drawing Sheets

IMAGE PROCESSING APPARATUS

FIELD

Embodiments described herein relate generally to an image processing apparatus and a paper feeding cassette moving system.

BACKGROUND

An image processing apparatus includes an automatic drawing-in mechanism for drawing in a paper feeding cassette that stores sheets. The automatic drawing-in mechanism draws in the paper feeding cassette into an apparatus main body up to a regular push-in position where the paper feeding cassette comes into contact with the apparatus main body. The image processing apparatus including the automatic drawing-in mechanism has a remedy structure for a case in which the automatic drawing-in mechanism fails to function. With the remedy structure, a user manually pushes in the paper feeding cassette to restore the automatic drawing-in mechanism. However, if the paper feeding cassette comes into contact with the apparatus main body in the regular push-in position, a push-in distance necessary for actuating the remedy structure sometimes cannot be secured.

DETAILED DESCRIPTION

Figure 1:
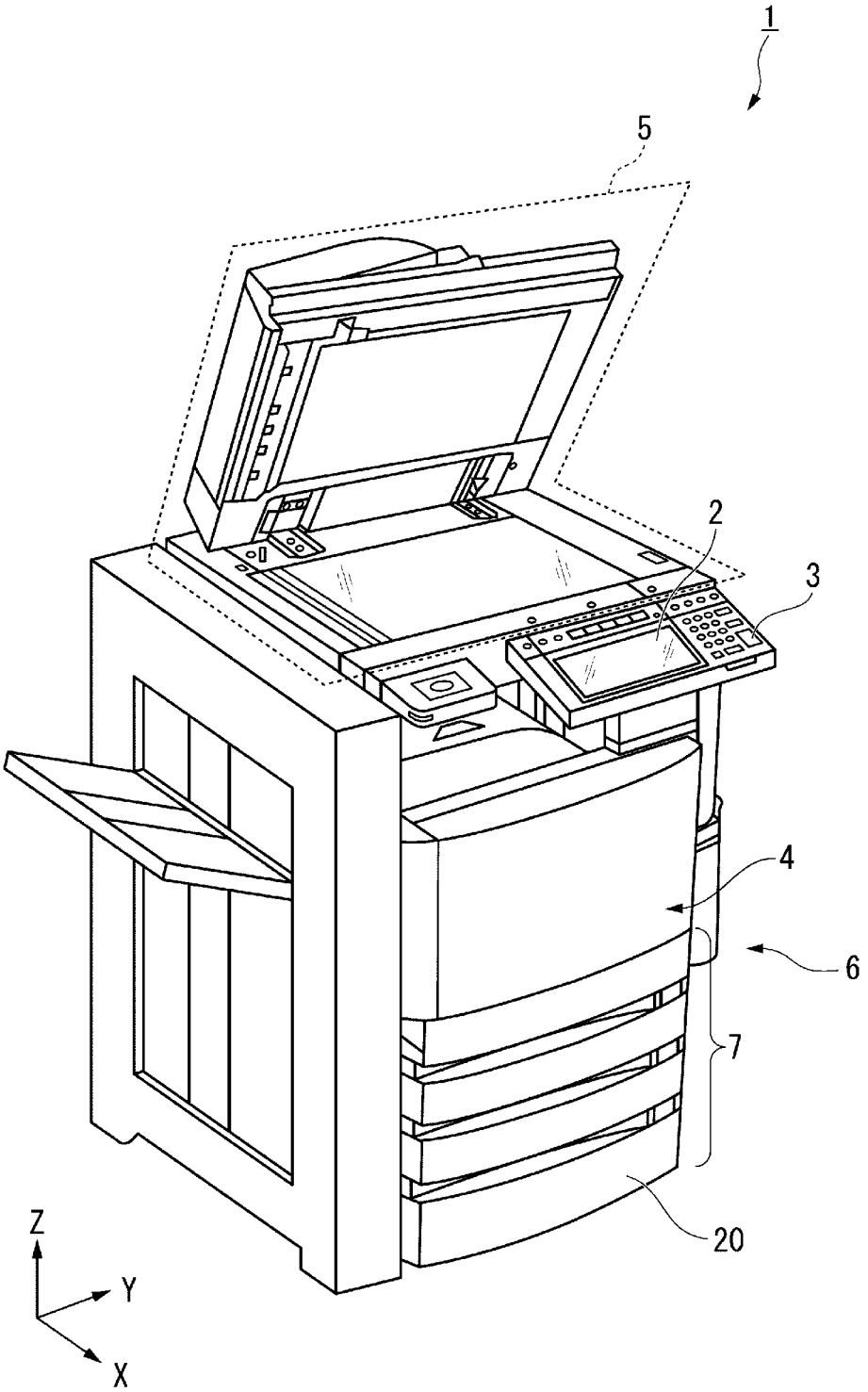
FIG. 1 is a perspective view of an image processing apparatus in an embodiment.

An image processing apparatus in an embodiment includes an apparatus main body, a paper feeding cassette, a drawing-in mechanism, and a restricting member. The paper feeding cassette is inserted into the apparatus main body to be capable of being drawn out in a first orientation along a first direction. The drawing-in mechanism is connected to the paper feeding cassette and draws the paper feeding cassette into the apparatus main body up to a drawing-in completion position along a second orientation opposite to the first orientation. The restricting member is displaceably interposed between the apparatus main body and the paper feeding cassette in a predetermined position and restricts the paper feeding cassette present in the drawing-in completion position from being displaced in the second orientation. If the paper feeding cassette is not connected to the drawing-in mechanism even if the paper feeding cassette is pushed in the second orientation up to the drawing-in completion position, the restricting member is displaced from the predetermined position to allow the paper feeding cassette to be displaced in the second orientation with respect to the apparatus main body.

The image processing apparatus in the embodiment is explained below with reference to the drawings.

In the following explanation, a depth direction (a first direction) is represented as an X-axis direction. A left-right direction (a second direction) is represented as a Y-axis direction. An up-down direction is represented as a Z-axis direction. The depth direction, the left-right direction, and the up-down direction are orthogonal to one another. In the figures, an arrow X direction is a near side (a first orientation) and the opposite of the arrow X direction is a depth side (a second orientation). In the figures, an arrow Y direction is a right side and the opposite of the arrow Y direction is a left side. In the figures, an arrow Z direction is an upper side and the opposite of the arrow Z direction is a lower side.

FIG. 1 is a perspective view of an image processing apparatus 1 in the embodiment. The image processing apparatus 1 in this embodiment is an image forming apparatus such as a multi function peripheral (MFP) printer or a copying machine. For example, the image processing apparatus 1 is set in a workplace. In the following explanation, an example is explained in which the image processing apparatus 1 is the image forming apparatus illustrated in FIG. 1.

As illustrated in FIG. 1, the image processing apparatus 1 includes a display 2, a control panel unit 3, an image forming unit 4, an image reading unit 5, an apparatus main body 6, and a sheet storing unit 7. The display 2 and the control panel unit 3 are used if a user operates the image processing apparatus 1. The image forming unit 4 forms an image on a sheet. The image reading unit 5 converts characters and images printed on a sheet into electronic data.

The apparatus main body 6 is a housing that incorporates the display 2, the control panel unit 3, the image forming unit 4, the image reading unit 5, and the sheet storing unit 7. The apparatus main body 6 incorporates the sheet storing unit 7 in an internal space in a lower part. The sheet storing unit 7 includes paper feeding cassettes 20.

Figure 2:
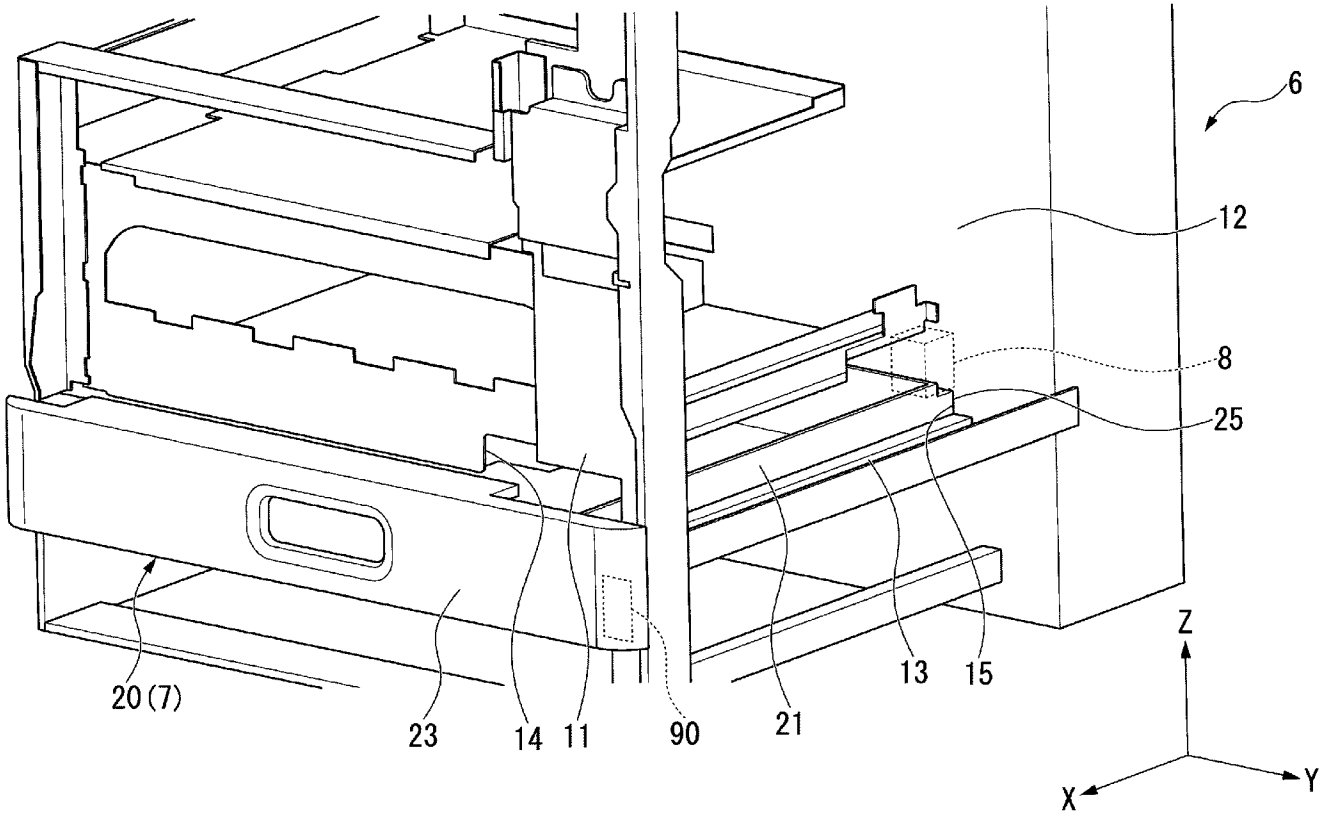
FIG. 2 is a perspective view of an internal structure in a lower part of the image processing apparatus viewed from a near side.

FIG. 2 is a perspective view of an internal structure in a lower part of the image processing apparatus 1 in the embodiment viewed from the near side. In FIG. 2, about the paper feeding cassettes 20 configuring the sheet storing unit 7, the paper feeding cassettes 20 excluding one paper feeding cassette 20 are not denoted by a reference numeral or sign.

As illustrated in FIG. 2, the apparatus main body 6 includes a front wall 11, an inner wall 12, and slide sections 13. The front wall 11 divides an internal space from a near side. A through-hole 14 is formed in the front wall 11. The through-hole 14 causes the paper feeding cassette 20 to pass if the paper feeding cassette 20 is drawn in and out. The inner wall 12 divides the internal space from the depth side. An introducing hole 15 is formed in the inner wall 12. The introducing hole 15 pierces through the inner wall 12 in a depth direction. If the paper feeding cassette 20 is inserted into the apparatus main body 6, the introducing hole 15 causes a part of the paper feeding cassette 20 to pass.

A pair of left and right slide sections 13 are present for each of the paper feeding cassettes 20. The pair of left and right slide sections 13 support the paper feeding cassette 20. The slide sections 13 are disposed between the front wall 11 and the inner wall 12. The slide sections 13 support the paper feeding cassette 20 to be capable of translating and capable of reciprocating in the depth direction with respect to the apparatus main body 6.

The paper feeding cassette 20 is inserted into the apparatus main body 6. The paper feeding cassette 20 is capable of being drawn out to the near side from the apparatus main body 6. The left-right direction of the paper feeding cassette 20 is represented as a width direction. The paper feeding cassette 20 is displaced in both directions along the depth direction. In the following explanation, concerning the paper feeding cassette 20, unless particularly described otherwise, the explanation is provided based on the premise that the paper feeding cassette 20 is inserted into the apparatus main body 6 and present in a position where displacement to the depth side is restricted. The paper feeding cassette 20 includes a cassette main body 21 and a front cover 23.

The cassette main body 21 stores sheets. The cassette main body 21 has a box shape opened upward. The cassette main body 21 is housed in the apparatus main body 6. The cassette main body 21 is present between the pair of left and right slide sections 13. The left and right both side portions of the cassette main body 21 are respectively supported by the apparatus main body 6 via the slide sections 13.

The front cover 23 covers the cassette main body 21 from the near side. The front cover 23 has a rectangular shape having length in the width direction. The front cover 23 is formed larger than the cassette main body 21 to the left and the right. The front cover 23 overlaps the entire cassette main body 21 if viewed from the near side and protrudes further to the left and right both sides than the cassette main body 21.

Figure 3:
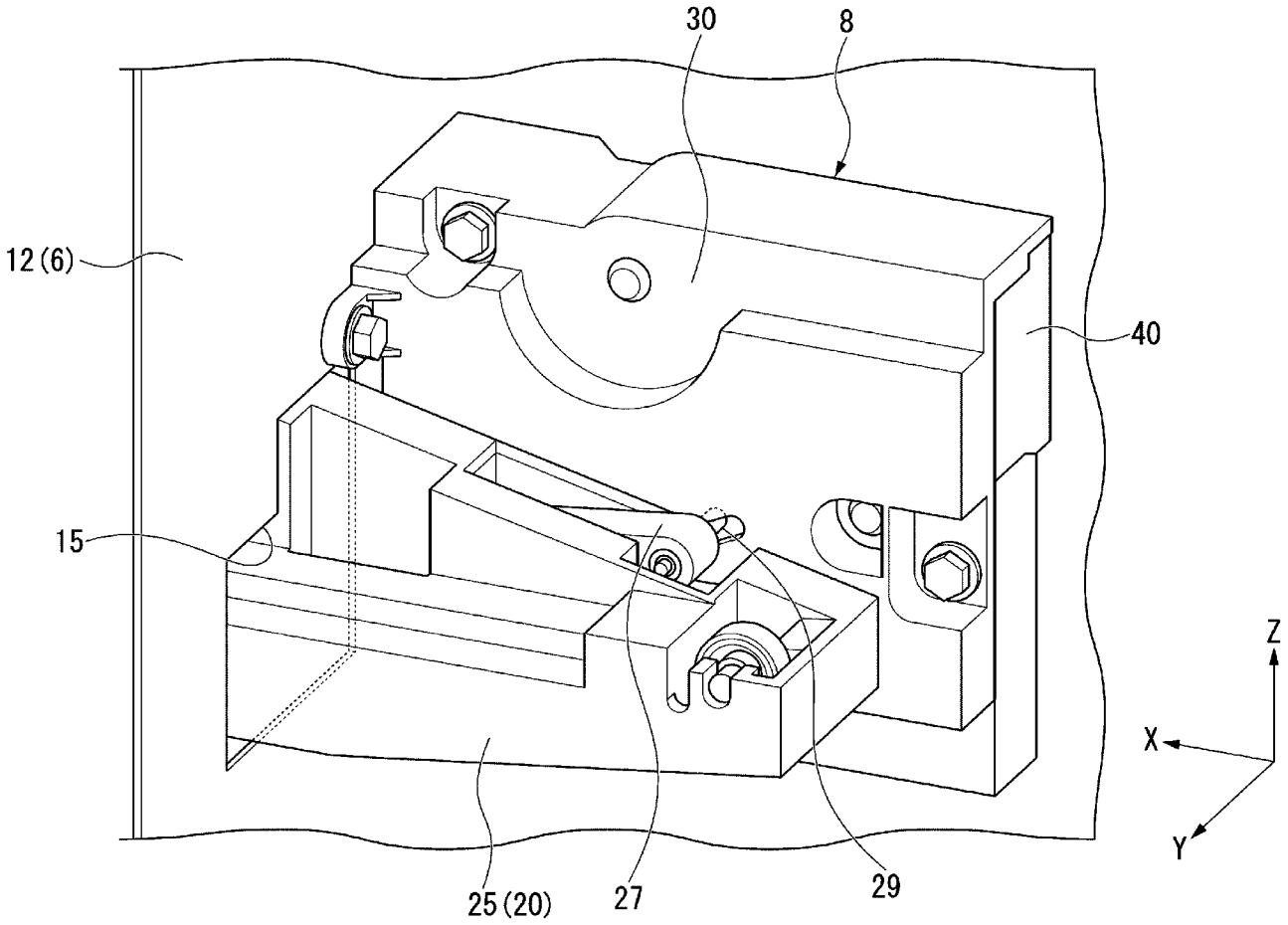
FIG. 3 is a perspective view of the internal structure of the lower part of the image processing apparatus viewed from a depth side.

FIG. 3 is a perspective view of an internal structure of a lower part of the image processing apparatus 1 in the embodiment viewed from the depth side.

As illustrated in FIG. 3, the paper feeding cassette 20 includes a drawing-in end 25. The drawing-in end 25 is disposed at the end portion on the depth side of the paper feeding cassette 20. The drawing-in end 25 is disposed on the right side with respect to an intermediate position of the pair of left and right slide sections 13 in the left-right direction (see FIG. 2). The drawing-in end 25 pierces through the introducing hole 15 of the inner wall 12. The drawing-in end 25 includes a link member 27 and a pin member 29.

The link member 27 is capable of turning, with respect to the cassette main body 21, around an axis extending along the left-right direction. The pin member 29 is coupled to the link member 27. The pin member 29 is disposed behind a turning center of the link member 27. For example, the pin member 29 has a columnar shape. The pin member 29 projects to the left side from the link member 27. The pin member 29 is displaced in the up-down direction with respect to the cassette main body 21 according to up-down swinging of the link member 27.

The image processing apparatus 1 includes a drawing-in mechanism 8. The drawing-in mechanism 8 is connected to the paper feeding cassette 20 and draws the paper feeding cassette 20 into the internal space of the apparatus main body 6. In this embodiment, a state in which the drawing-in mechanism 8 and the paper feeding cassette 20 are connected is a state in which the drawing-in mechanism 8 pushes the paper feeding cassette 20 to the depth side. The drawing-in mechanism 8 applies force for inserting the paper feeding cassette 20 into the apparatus main body 6. The drawing-in mechanism 8 draws in the paper feeding cassette 20 to the depth side up to a drawing-in completion position from a drawing-in start position. The drawing-in completion position is an end portion on the depth side in a range in which force to the depth side is applied to the paper feeding cassette 20 by the drawing-in mechanism 8 in a moving range of the paper feeding cassette 20 with respect to the apparatus main body 6. The drawing-in completion position is a position illustrated in FIG. 4. A state of the drawing-in mechanism 8 waiting for connection to the paper feeding cassette 20 pushed in to the depth side toward the drawing-in start position is defined as a drawing-in waiting state. A state of the drawing-in mechanism 8 connectable to the paper feeding cassette 20 present in the drawing-in completion position is defined as a drawing-in completion state.

The drawing-in mechanism 8 is incorporated in the apparatus main body 6. The drawing-in mechanism 8 is disposed on the depth side of the inner wall 12 of the apparatus main body 6. The drawing-in mechanism 8 is disposed, with respect to the drawing-in end 25 of the paper feeding cassette 20, on side where the pin member 29 projects. The drawing-in mechanism 8 includes a cover 30 and a chassis 40.

The cover 30 has a substantial plate shape. The cover 30 is coupled to the inner wall 12 of the apparatus main body 6 such that the front and rear surfaces of the cover 30 face the left-right direction. The cover 30 is incapable of being relatively displaced with respect to the apparatus main body 6.

The chassis 40 has a substantial box shape having an opening. The chassis 40 is opened to the drawing-in end 25 side in the left-right direction. The chassis 40 is bonded to the cover 30 with an opening edge of the chassis 40 aligned with the edge of the cover 30. The chassis 40 is incapable of being relatively displaced with respect to the cover 30.

Figure 4:
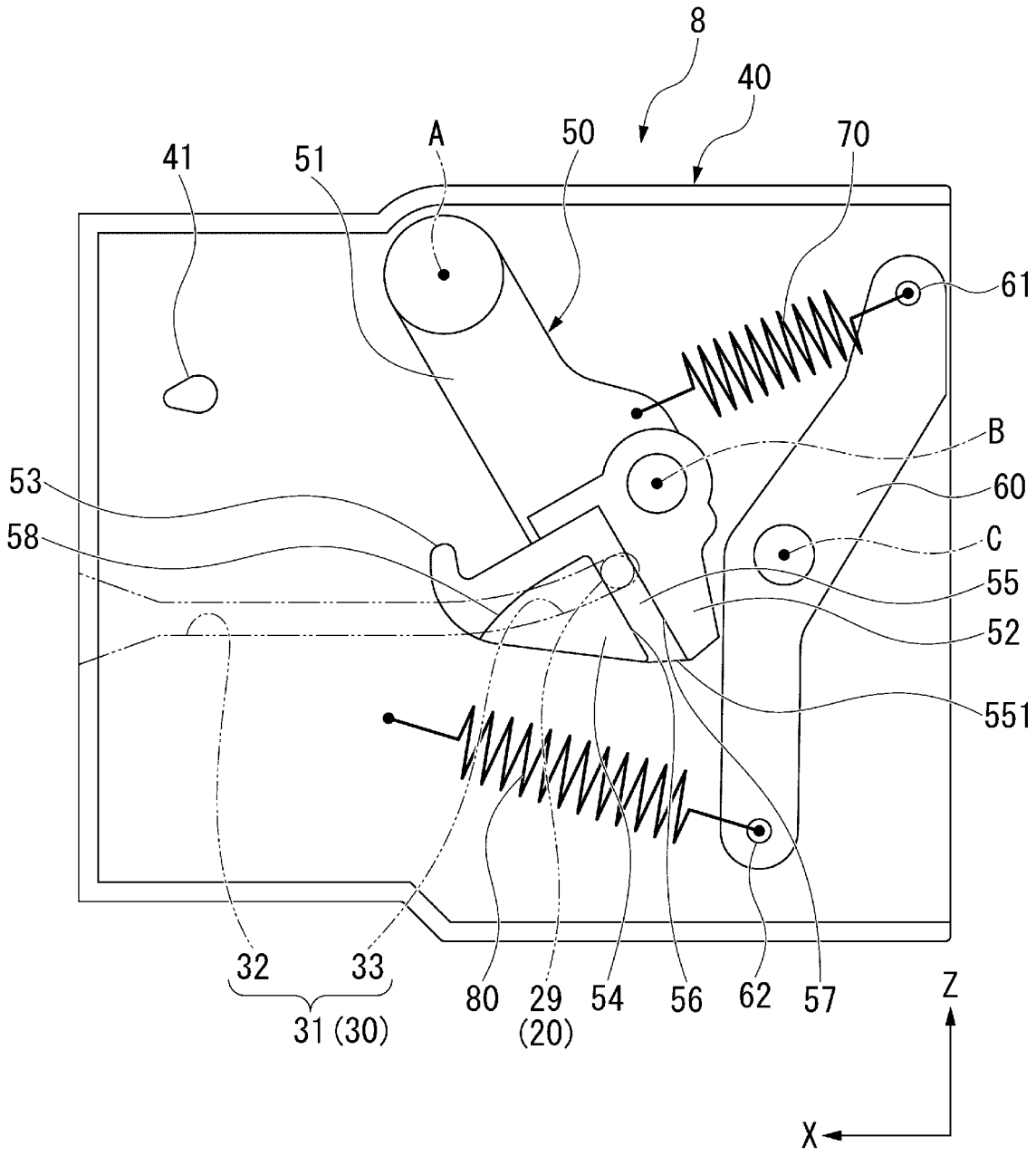
FIG. 4 is a side view illustrating a drawing-in mechanism in the embodiment.
Figure 5:
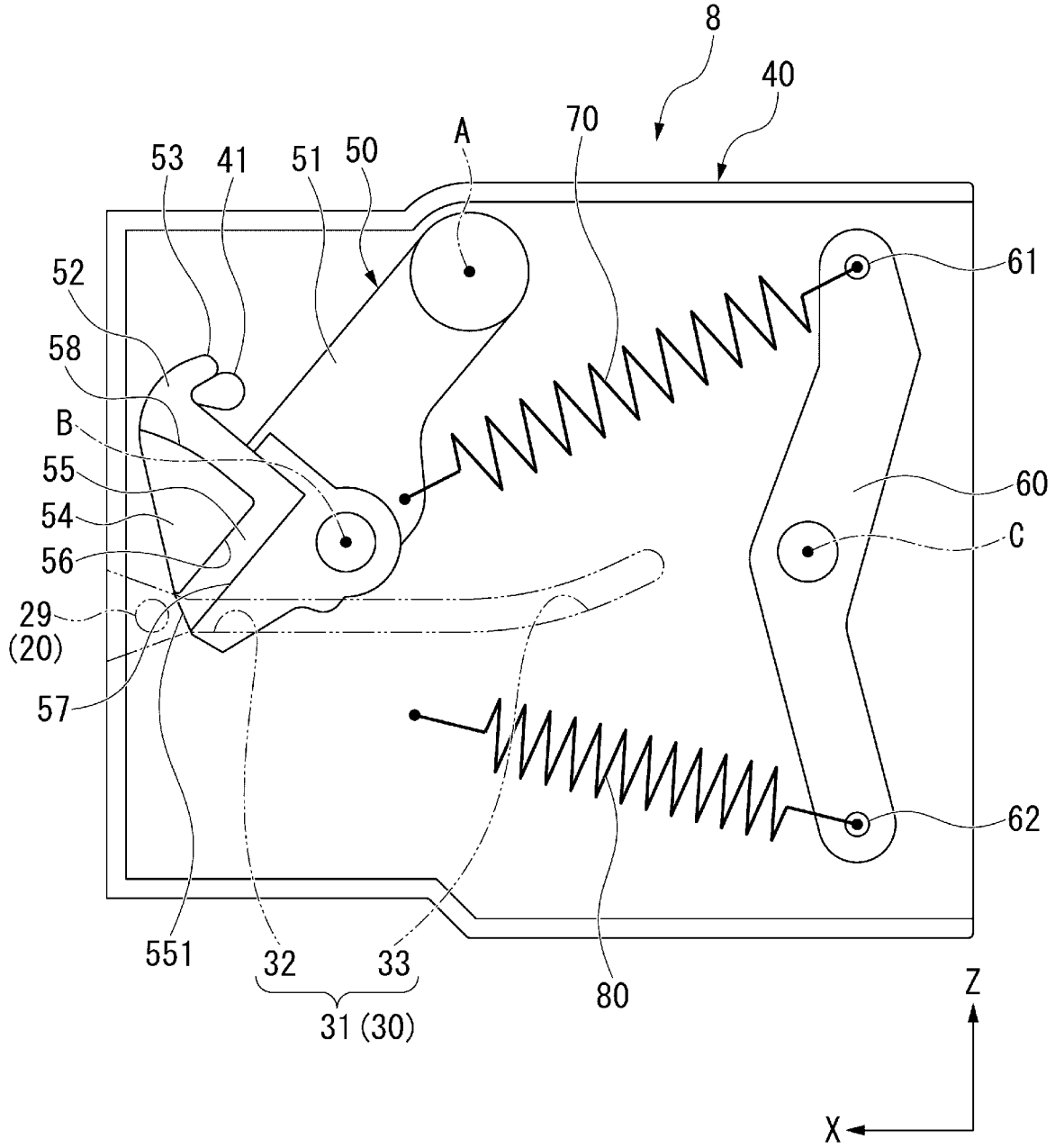
FIG. 5 is a side view illustrating the drawing-in mechanism.

FIGS. 4 and 5 are side views illustrating the drawing-in mechanism 8 in the embodiment. FIG. 4 illustrates the drawing-in completion state. FIG. 5 illustrates the drawing-in waiting state. In FIGS. 4 and 5, the cover 30 and the pin member 29 of the paper feeding cassette 20 are indicated by imaginary lines.

As illustrated in FIG. 4, a guide groove 31 is formed on the cover 30. The guide groove 31 has length in the depth direction. The end portion on the near side of the guide groove 31 is opened at the end edge on the near side of the cover 30. The width of the end portion on the near side of the guide groove 31 is narrowed toward the depth side. The guide groove 31 has substantially fixed width excluding the end portion on the near side. The guide groove 31 includes a front section 32 and an inner section 33. The front section 32 includes the end portion on the near side of the guide groove 31. The front section 32 is parallel to the depth direction if viewed from the left-right direction. The inner section 33 is connected to the front section 32. The inner section 33 extends slightly to the upper side toward the depth side from the front section 32. The inner section 33 extends in an arcuate shape centering on a main rotation axis A if viewed from the left-right direction. However, the entire guide groove 31 may be substantially parallel to the depth direction.

The drawing-in mechanism 8 includes a locking section 41, a lever 50, an elastic member 70, an auxiliary lever 60, and an auxiliary elastic member 80. In the following explanation, a rotation direction of a member turning around an axis extending along the left-right direction is explained as a direction viewed from the right side.

The locking section 41 is present on the inner side of the chassis 40. The locking section 41 is incapable of being relatively displaced with respect to the chassis 40. The locking section 41 is formed integrally with the chassis 40.

The lever 50 is present on the inner side of the chassis 40. The lever 50 is provided to be capable of turning, with respect to the cover 30 and the chassis 40, around the main rotation axis A extending along the left-right direction. The main rotation axis A is present above the guide groove 31. The lever 50 turns around the main rotation axis A if shifting between the drawing-in waiting state and the drawing-in completion state. The lever 50 turns in the counterclockwise direction if shifting from the drawing-in waiting state to the drawing-in completion state. The lever 50 is restricted from turning in the counterclockwise direction in a position where the lever 50 slightly turns in the counterclockwise direction around the main rotation axis A from the drawing-in completion state. However, the lever 50 may be restricted from turning in the counterclockwise direction around the main rotation axis A in the drawing-in completion state. The lever 50 turns in the clockwise direction if shifting from the drawing-in completion state to the drawing-in waiting state. In the following explanation of the lever 50, the drawing-in completion state is explained unless particularly described otherwise. The lever 50 includes a lever main body 51 and a pin engaging section 52.

The lever main body 51 is supported by the chassis 40 to be capable of turning around the main rotation axis A. The lever main body 51 is incapable of translating with respect to the chassis 40. The elastic member 70 is connected to the lever main body 51.

The pin engaging section 52 is present at the distal end portion of the lever 50. The pin engaging section 52 is present below the main rotation axis A if viewed from the left-right direction. The pin engaging section 52 is present on the right side of the lever main body 51. The pin engaging section 52 is supported by the lever main body 51 to be capable of turning around a sub-rotation axis B extending along the left-right direction. The sub-rotation axis B is present below the main rotation axis A and above the guide groove 31. The pin engaging section 52 is incapable of translating with respect to the lever main body 51. If the lever 50 shifts from the drawing-in waiting state to the drawing-in completion state, the pin engaging section 52 is displaced to the depth side according to the turning in the counterclockwise direction of the lever main body 51. The pin engaging section 52 is restricted from turning in the clockwise direction and allowed to turn in the counterclockwise direction in a position with respect to the lever main body 51 illustrated in FIGS. 4 and 5.

As illustrated in FIG. 5, the pin engaging section 52 includes a hook 53. The hook 53 is separably locked by the locking section 41 of the chassis 40 in the drawing-in waiting state. The pin engaging section 52 turns in the counterclockwise direction with respect to the lever main body 51, whereby the hook 53 separates from the locking section 41.

As illustrated in FIG. 4, the pin engaging section 52 includes a side surface 54 opposed to the cover 30. The side surface 54 faces the drawing-in end 25 side in the left-right direction. An engaging groove 55 is formed on the side surface 54. The entire locking groove 55 is present on the opposite side of the main rotation axis A with respect to the sub-rotation axis B if viewed from the left-right direction. The engaging groove 55 includes a first end portion 551 in a position below the guide groove 31 if viewed from the left-right direction. The first end portion 551 is opened on the opposite side of the main rotation axis A. The first end portion 551 overlaps the front section 32 of the guide groove 31 in the drawing-in waiting state (see FIG. 5). The engaging groove 55 extends from the first end portion 551 toward the main rotation axis A. The engaging groove 55 extends at substantially fixed width. The engaging groove 55 includes a first sidewall 56 that defines the engaging groove 55 from the near side and a second sidewall 57 that defines the engaging groove 55 from the depth side.

The pin engaging section 52 includes a contact surface 58. The contact surface 58 is connected to the end portion on the main rotation axis A side of the first sidewall 56. The contact surface 58 extends from the first sidewall 56 to the opposite side of the second sidewall 57. The contact surface 58 is formed to the edge on the near side of the pin engaging section 52. The contact surface 58 is bent in a convex shape in the clockwise direction centering on the sub-rotation axis B if viewed from the left-right direction. The contact surface 58 crosses the guide groove 31 at an acute angle if viewed from the left-right direction.

The auxiliary lever 60 is present on the inner side of the chassis 40. The auxiliary lever 60 is present further on the depth side than the lever 50. The auxiliary lever 60 is provided to be capable of turning, with respect to the apparatus main body 6, around an axis C extending along the left-right direction. The auxiliary lever 60 includes a first connecting section 61 and a second connecting section 62. The elastic member 70 is connected to the first connecting section 61. The auxiliary elastic member 80 is connected to the second connecting section 62. The first connecting section 61 and the second connecting section 62 are in a positional relation in which moment by an urging force of the elastic member 70 and moment by an urging force of the auxiliary elastic member 80 are in opposite directions each other. In an example illustrated in FIGS. 4 and 5, the first connecting section 61 is present above the axis C. In the example illustrated in FIGS. 4 and 5, the second connecting section 62 is present below the axis C.

The elastic member 70 is present on the inner side of the chassis 40. The elastic member 70 is a tensile coil spring. The elastic member 70 is connected to a part below the main rotation axis A in the lever main body 51 of the lever 50. The elastic member 70 urges, with a restoration force, the lever main body 51 and the first connecting section 61 of the auxiliary lever 60 to approach each other. The elastic member 70 urges the lever main body 51 of the lever 50 to the depth side and applies torque in the counterclockwise direction to the lever main body 51. The elastic member 70 urges the first connecting section 61 to the near side and applies torque in the counterclockwise direction to the auxiliary lever 60.

The auxiliary elastic member 80 is present on the inner side of the chassis 40. The auxiliary elastic member 80 is a tensile coil spring. The auxiliary elastic member 80 is connected to the second connecting section 62 and the chassis 40 of the auxiliary lever 60. The auxiliary elastic member 80 urges, with a restoration force, the second connecting section 62 to the near side with respect to the chassis 40 and applies torque in the clockwise direction to the auxiliary lever 60. The auxiliary elastic member 80 pulls the elastic member 70 in an extending direction via the auxiliary lever 60.

As illustrated in FIG. 2, the image processing apparatus 1 includes a restricting member 90. The restricting member 90 is displaceably interposed between the apparatus main body 6 and the paper feeding cassette 20 in a predetermined position. The restricting member 90 is restricted from being displaced to the depth side with respect to the apparatus main body 6. The restricting member 90 restricts the front cover 23 of the paper feeding cassette 20 present in the drawing-in completion position from being displaced to the depth side. The restricting member 90 restricts the paper feeding cassette 20 from being displaced to the depth side with respect to the apparatus main body 6. The restricting member 90 allows the paper feeding cassette 20 present in the drawing-in completion position to be displaced to the depth side with respect to the apparatus main body 6 in an allowable position displaced from the predetermined position. In the following explanation of the restricting member 90, the restricting member 90 present in the predetermined position is explained unless particularly described otherwise.

First Embodiment

Figure 6:
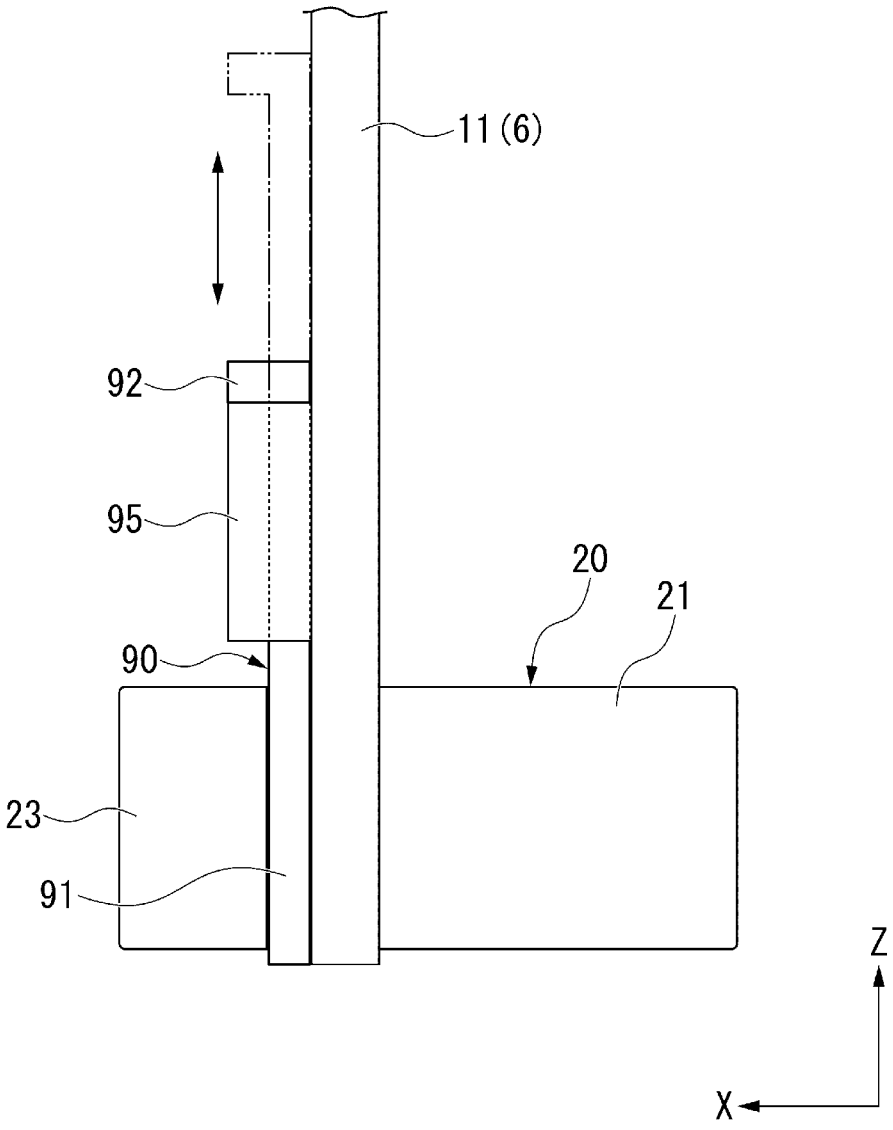
FIG. 6 is a side view illustrating a peripheral structure for a restricting member in the image processing apparatus.

FIG. 6 is a side view illustrating a peripheral structure of the restricting member 90 in the image processing apparatus 1 in a first embodiment.

The restricting member 90 in the first embodiment is explained. As illustrated in FIG. 6, the restricting member 90 is provided in the apparatus main body 6. The restricting member 90 has thickness in the depth direction. The restricting member 90 includes a contact section 91 and a locking convex section 92. The contact section 91 has length in the up-down direction if viewed from the left-right direction. The contact section 91 has fixed thickness if viewed from the left-right direction. The contact section 91 is sandwiched by the front cover 23 of the paper feeding cassette 20 present in the drawing-in completion position and the front wall 11 of the apparatus main body 6. The contact section 91 extends upward from a portion located between the front cover 23 and the front wall 11. The locking convex section 92 is connected to the upper end of the contact section 91. The locking convex section 92 projects further to a near side than the contact section 91.

The image processing apparatus 1 includes a holder 95 that movably holds the restricting member 90. The holder 95 is coupled to the apparatus main body 6 to be incapable of being relatively displaced. The holder 95 is present on the near side of the contact section 91 of the restricting member 90 present in a predetermined position. For example, the holder 95 surrounds the contact section 91 from three directions of the near side, the left, and the right. The holder 95 supports the contact section 91 to be movable upward. The holder 95 engages with the locking convex section 92 from below and restricts downward movement of the restricting member 90. The holder 95 guides the restricting member 90 to move between the predetermined position and an allowable position present above the predetermined position. The allowable position is indicated by an imaginary line in FIG. 6. If the restricting member 90 is present above the predetermined position, the holder 95 allows a fall due to a dead weight of the restricting member 90 toward the predetermined position.

The operation of the drawing-in mechanism 8 in inserting the paper feeding cassette 20 into the apparatus main body 6 is explained with reference to FIGS. 4 and 5.

If the paper feeding cassette 20 is inserted into the apparatus main body 6, the drawing-in end 25 passes through the introducing hole 15 of the inner wall 12. At this time, the drawing-mechanism 8 is in the drawing-in waiting state. The pin member 29 enters the guide groove 31 of the cover 30 of the drawing-in mechanism 8 from the end portion on the near side. If the pin member 29 enters a depth side along the guide member 31, the pin member 29 enters the engaging groove 55 of the lever 50 from the first end portion 551. FIG. 5 illustrates a state in which the paper feeding cassette 20 is inserted into the apparatus main body 6 and the pin member 29 and the lever 50 are in contact.

If the paper feeding cassette 20 is further inserted to the depth side, the pin member 29 comes into contact with the second sidewall 57, which defines the engaging groove 55 from the depth side, and pushes the lever 50 to the depth side. Since the lever 50 is pushed to the depth side, the pin engaging section 52 turns in the counterclockwise direction with respect to the lever main body 51 and the locking section 41 and the hook 53 are disengaged.

If the locking section 41 and the hook 53 are disengaged, the lever 50 is allowed to turn in the counterclockwise direction around the main rotation axis A. The lever 50 starts to turn in the counterclockwise direction from the drawing-in waiting state to the drawing-in completion state with respective restoration forces of the elastic member 70 and the auxiliary elastic member 80. If the lever 50 starts to turn in the counterclockwise direction, the first sidewall 56, which defines the engaging groove 55 from the near side, comes into contact with the pin member 29 of the paper feeding cassette 20 present in the drawing-in start position. Since the first sidewall 56 comes into contact with the pin member 29 from the near side, the drawing-in mechanism 8 is connected to the paper feeding cassette 20. The lever 50 presses the pin member 29 to the depth side. The pin member 29 enters the depth side along the guide groove 31 with a pressing force applied from the lever 50. Since the pin member 29 is displaced to the depth side, the paper feeding cassette 20 is inserted into the apparatus main body 6. The paper feeding cassette 20 is displaced to the inner side until the paper feeding cassette 20 comes into contact with the restricting member 90 present in the predetermined position. If the paper feeding cassette 20 comes into contact with the restricting member 90 in the drawing-in completion position and is restricted from being displaced to the depth side, the turning of the lever 50 is stopped and the drawing-in mechanism 8 changes to the drawing-in completion state.

The operation of the drawing-in mechanism 8 in drawing out the paper feeding cassette 20 from the apparatus main body 6 is explained with reference to FIGS. 4 and 5.

If the paper feeding cassette 20 is drawn out from the apparatus main body 6, the pin member 29 moves to the near side along the guide groove 31. The pin member 29 comes into contact with the first sidewall 56 of the engaging groove 55 and pushes the lever 50 to the near side. The lever 50 starts to turn in the clockwise direction from the drawing-in completion state to the drawing-in waiting state while resisting the respective restoration forces of the elastic member 70 and the auxiliary elastic member 80. If the pin member 29 reaches the drawing-in start position, the hook 53 engages with the locking section 41 of the chassis 40 and the pin member 29 retracts from the engaging groove 55. Since the hook 53 engages with the locking section 41, the drawing-in mechanism 8 changes to the drawing-in waiting state.

In a state in which the paper feeding cassette 20 is drawn out until the pin member 29 retracts from the guide groove 31, the hook 53 of the lever 50 sometimes does not engage with the locking section 41 because of some cause. In this case, in a state in which the pin member 29 does not get into the engaging groove 55, the lever 50 is displaced to a position corresponding to the drawing-in completion state by the restoration force of the elastic member 70. In this state, the drawing-in mechanism 8 does not operate even if the paper feeding cassette 20 is inserted into the apparatus main body 6 and the pin member 29 is moved to the drawing-in start position. A restoration method in the case in which the drawing-in mechanism 8 is in a state corresponding to the drawing-in completion state in a state in which the paper feeding cassette 20 is sufficiently drawn out is explained with reference to FIGS. 7 and 8.

Figure 7:
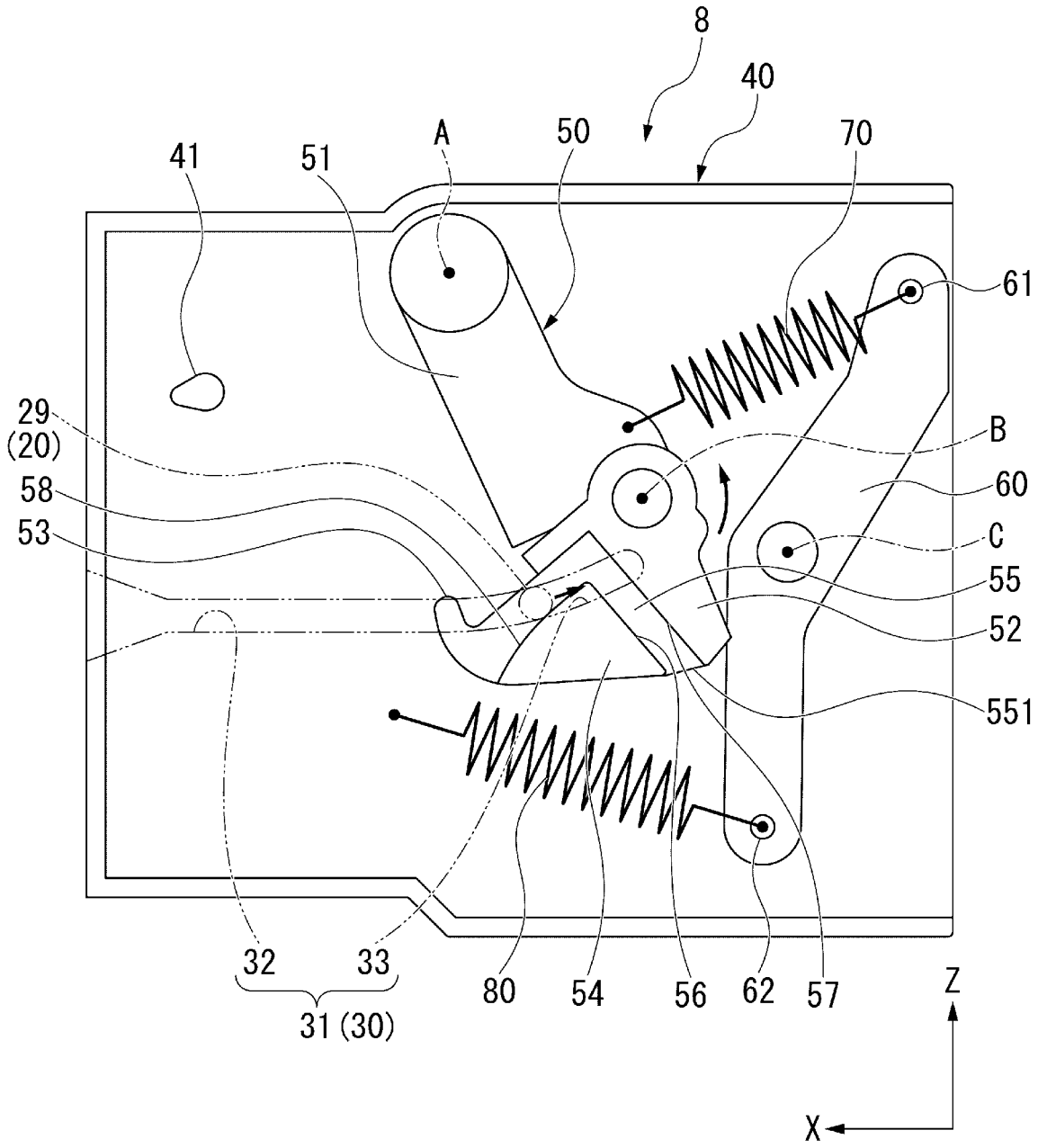
FIG. 7 is a side view illustrating a restoring operation for the drawing-in mechanism.
Figure 8:
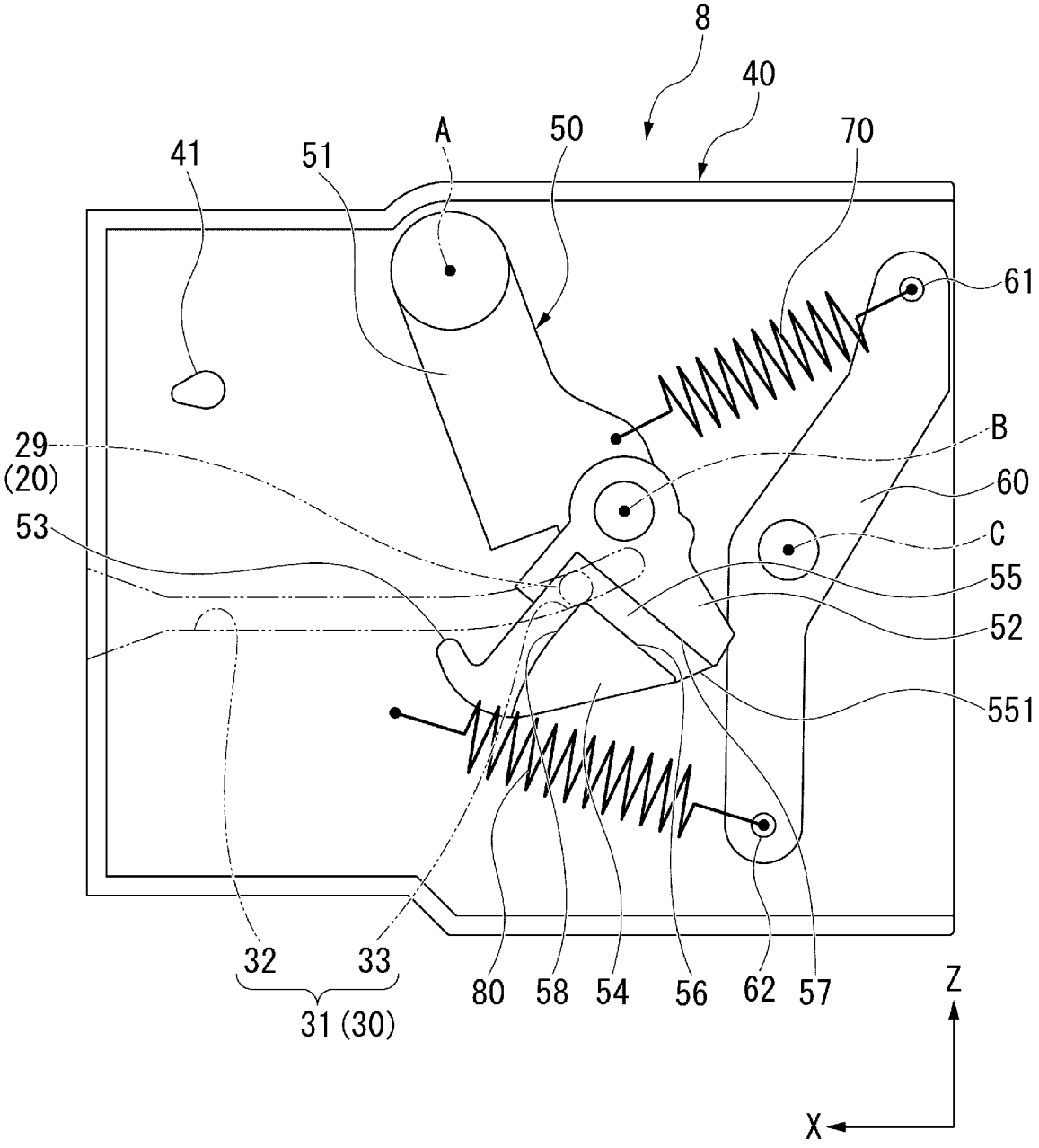
FIG. 8 is a side view illustrating the restoring operation of the drawing-in mechanism.

FIGS. 7 and 8 are side views illustrating a restoring operation for the drawing-in mechanism 8 in the embodiment.

As illustrated in FIG. 7, the paper feeding cassette 20 is inserted into the apparatus main body 6 to cause the pin member 29 to enter the guide groove 31 of the cover 30 of the drawing-in mechanism 8. If entering the depth side along the guide groove 31, the pin member 29 comes into contact with the contact surface 58 of the pin engaging section 52. If the paper feeding cassette 20 is pushed in to the depth side, the pin member 29 slides on the contact surface 58 while moving to the depth side along the inner section 33 of the guide groove 31. The pin member 29 moves to the engaging groove 55 side along the contact surface 58 with respect to the pin engaging section 52 while pushing the pin engaging section 52 in the counterclockwise direction via the contact surface 58. As illustrated in FIG. 8, if the paper feeding cassette 20 is further pushed in to the depth side, the pin member 29 climbs over the end portion of the contact surface 58 and gets into the engaging groove 55. Consequently, it is possible to cause the pin member 29 to get into the engaging groove 55 of the drawing-in mechanism 8 in the drawing-in completion state.

Figure 9:
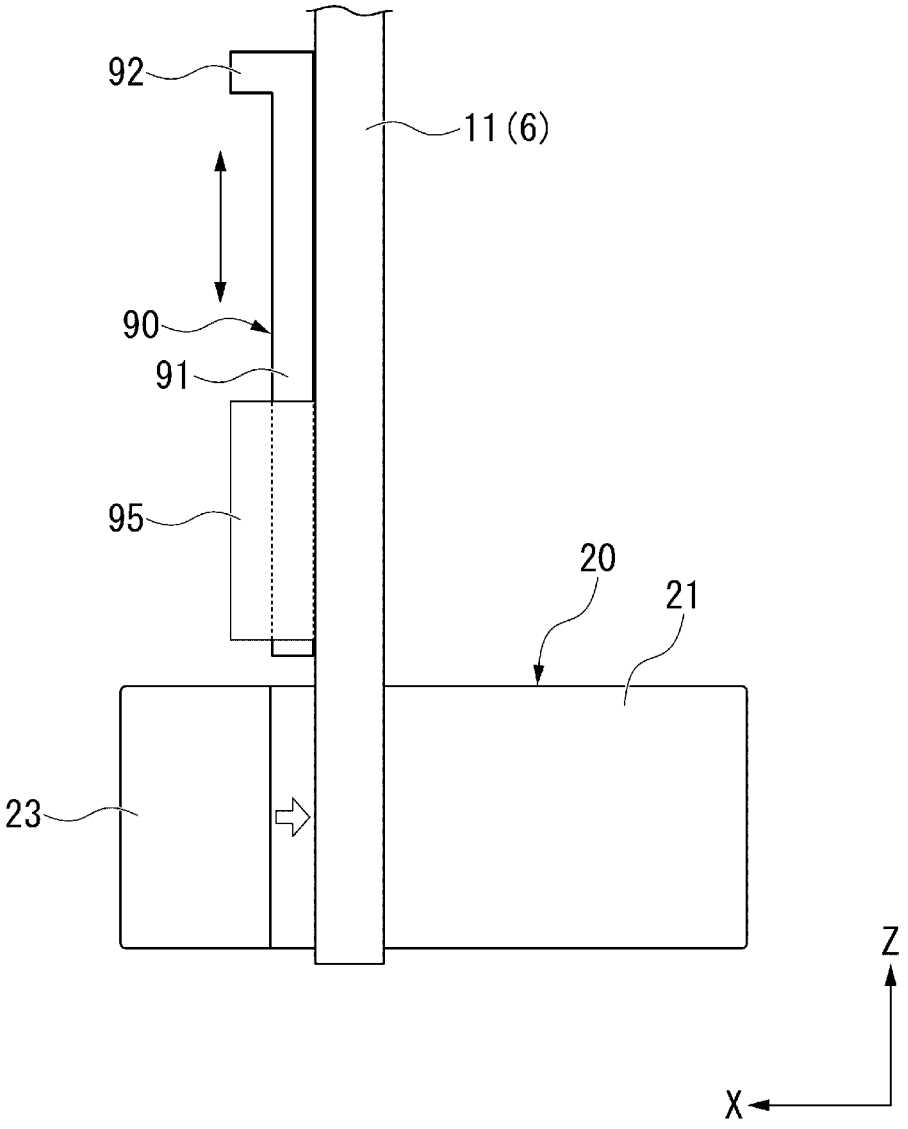
FIG. 9 is a side view illustrating action of the restricting member.

FIG. 9 is a side view illustrating action of the restricting member 90 in the embodiment.

Even if the paper feeding cassette 20 is pushed to the depth side up to the drawing-in completion position, the pin member 29 sometimes does not climb over the end portion of the contact surface 58. In this case, as illustrated in FIG. 9, the restricting member 90, which restricts the paper feeding cassettes 20 from moving to the depth side, is displaced from the predetermined position to the allowable position. If the restricting member 90 is present in the allowable position, the paper feeding cassette 20 is allowed to be displaced to the depth side with respect to the apparatus main body 6. The paper feeding cassette 20 is further pushed in to the depth side to cause the pin member 29 located on the contact surface 58 to climb over the end portion of the contact surface 58. The pin member 29 climbs over the end portion of the contact surface 58 to enter the engaging groove 55.

As explained above, the image processing apparatus 1 in this embodiment includes the drawing-in mechanism 8 and the restricting member 90. The drawing-in mechanism 8 is connected to the paper feeding cassette 20 to draw the paper feeding cassette 20 into the apparatus main body 6 up to the drawing-in completion position. The restricting member 90 is displaceably interposed between the apparatus main body 6 and the paper feeding cassette 20 in the predetermined position. If the paper feeding cassette 20 is not connected to the drawing-in mechanism 8 even if the paper feeding cassette 20 is pushed in to the depth side up to the drawing-in completion position, the restricting member 90 is displaced from the predetermined position to allow the paper feeding cassette 20 to be displaced to the depth side with respect to the apparatus main body 6. With this configuration, it is possible to secure a pushing-in distance necessary for actuating a remedy structure for restoring the drawing-in mechanism 8 by manually pushing in the paper feeding cassette 20.

The drawing-in mechanism 8 includes the cover 30, the lever 50, and the elastic member 70. The cover 30 is coupled to the apparatus main body 6 and includes the guide groove 31 for guiding the pin member 29 of the paper feeding cassette 20 along the depth direction. The lever 50 is provided to be capable of turning, with respect to the cover 30, around the main rotation axis A extending along the left-right direction. The lever 50 includes, at the distal end portion, the pin engaging section 52 that engages with the pin member 29. The pin engaging section 52 is capable of turning around the sub-rotation axis B extending along the left-right direction. The pin engaging section 52 includes the engaging groove 55 including the first sidewall 56 that defines the engaging groove 55 from the near side and the second sidewall 57 that defines the engaging groove 55 from the depth side and the contact surface 58 formed continuously to the first sidewall 56 and extending to the opposite side of the second sidewall 57. The contact surface 58 crosses the guide groove 31 in the drawing-in completion state. The elastic member 70 applies, to the lever 50, force for rotating the lever 50 to the depth side. With this configuration, simply by inserting the paper feeding cassette 20 into the apparatus main body 6, the pin member 29 slides on the contact surface 58 involving turning of the pin engaging section 52 and is disposed in the engaging groove 55. Therefore, if the paper feeding cassette 20 and the drawing-in mechanism 8 are not appropriately connected, a user can restore the drawing-in mechanism 8 to a state in which the paper feeding cassette 20 and the drawing-in mechanism 8 are appropriately connected and the paper feeding cassette 20 is inserted.

If the pin member 29 is located on the contact surface 58 in a state in which the paper feeding cassette 20 is restricted from moving to the depth side by the restricting member 90, the restricting member 90 is displaced from the predetermined position to move the paper feeding cassette 20 to the depth side, whereby the pin member 29 enters the engaging groove 55. With this configuration, if the pin member 29 does not enter the engaging groove 55 even if the paper feeding cassette 20 is pushed in to the drawing-in completion position, it is possible to allow further displacement to the depth side of the paper feeding cassette 20 and dispose the pin member 29 in the engaging groove 55.

The image processing apparatus 1 further includes the holder 95 that movably holds the restricting member 90 and guides the restricting member 90 to move between the predetermined position and the allowable position. With this configuration, improvement of operability of the restricting member 90 can be achieved. The restricting member 90 can be prevented from dropping.

Since the allowable position of the restricting member 90 is present above the predetermined position, the restricting member 90 can be returned to the predetermined position by the dead weight of the restricting member 90. By automatically returning the restricting member 90 to the predetermined position, it is possible to dispose the restricting member 90 in the predetermined position at a normal time without requiring special operation.

The restricting member 90 is disposed on the same side as the drawing-in mechanism 8 with respect to the intermediate position of the pair of slide sections 13 in the left-right direction. If the restricting member 90 is present on the opposite side of the drawing-in mechanism 8 with respect to the intermediate position of the pair of slide sections 13 in the left-right direction, the paper feeding cassette 20 sometimes tilts with respect to the depth direction if the restricting member 90 is disposed in the allowable position and the paper feeding cassette 20 is manually pushed in. In this case, it is likely that the pin member 29 of the paper feeding cassette 20 cannot be sufficiently pushed into the drawing-in mechanism 8. According to this embodiment, if the restricting member 90 is disposed in the allowable position and the paper feeding cassette 20 is manually pushed in, the paper feeding cassette 20 can be prevented from tilting with respect to the depth direction. Therefore, the paper feeding cassette 20 can be surely pushed into the drawing mechanism 8 to restore the drawing-in mechanism 8.

The restricting member 90 is provided in the apparatus main body 6. With this configuration, while performing operation for, for example, drawing out the paper feeding cassette 20 with one hand, the user can operate the restricting member 90 with the other hand. Therefore, improvement of workability in restoring the drawing-in mechanism 8 can be achieved.

Figure 10:
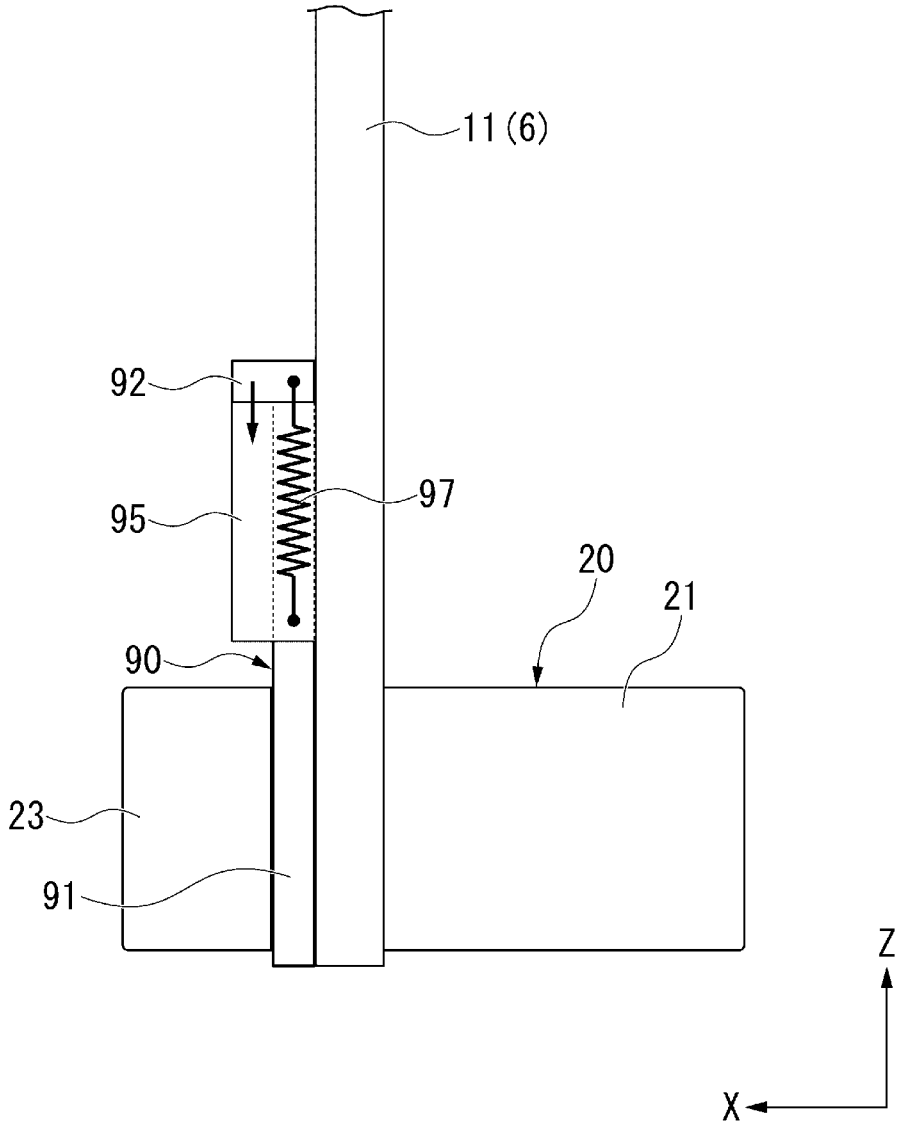
FIG. 10 is a side view illustrating a peripheral structure of the restricting member in the image processing apparatus in a modification of a first embodiment.

FIG. 10 is a side view illustrating a peripheral structure of the restricting member 90 in the image processing apparatus 1 in a modification of the first embodiment.

As illustrated in FIG. 10, the image processing apparatus 1 may include an urging member 97 that urges the restricting member 90 in a direction from the predetermined position to the allowable position. In an example illustrated in FIG. 10, the urging member 97 is a tensile coil spring. However, the urging member 97 may be a compression coil spring, a leaf spring, or the like. By providing the urging member 97, the restricting member 90 can be surely returned to the predetermined position. By automatically returning the restricting member 90 to the predetermined position, it is possible to dispose the restricting member 90 in the predetermined position at the normal time without requiring special operation.

Second Embodiment

Figure 11:
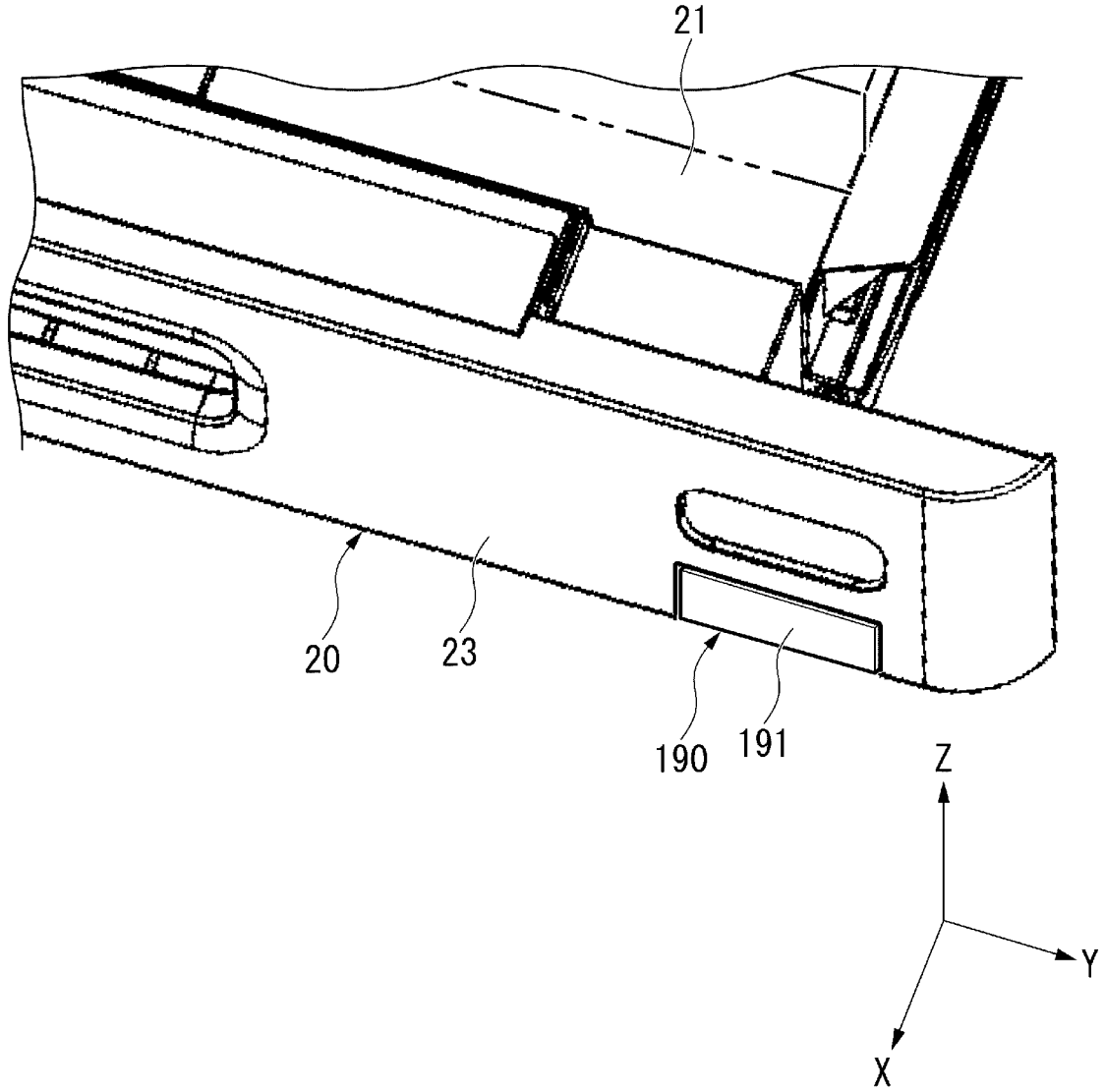
FIG. 11 is a perspective view of a peripheral structure of a restricting member in the image processing apparatus in a second embodiment viewed from the near side.
Figure 12:
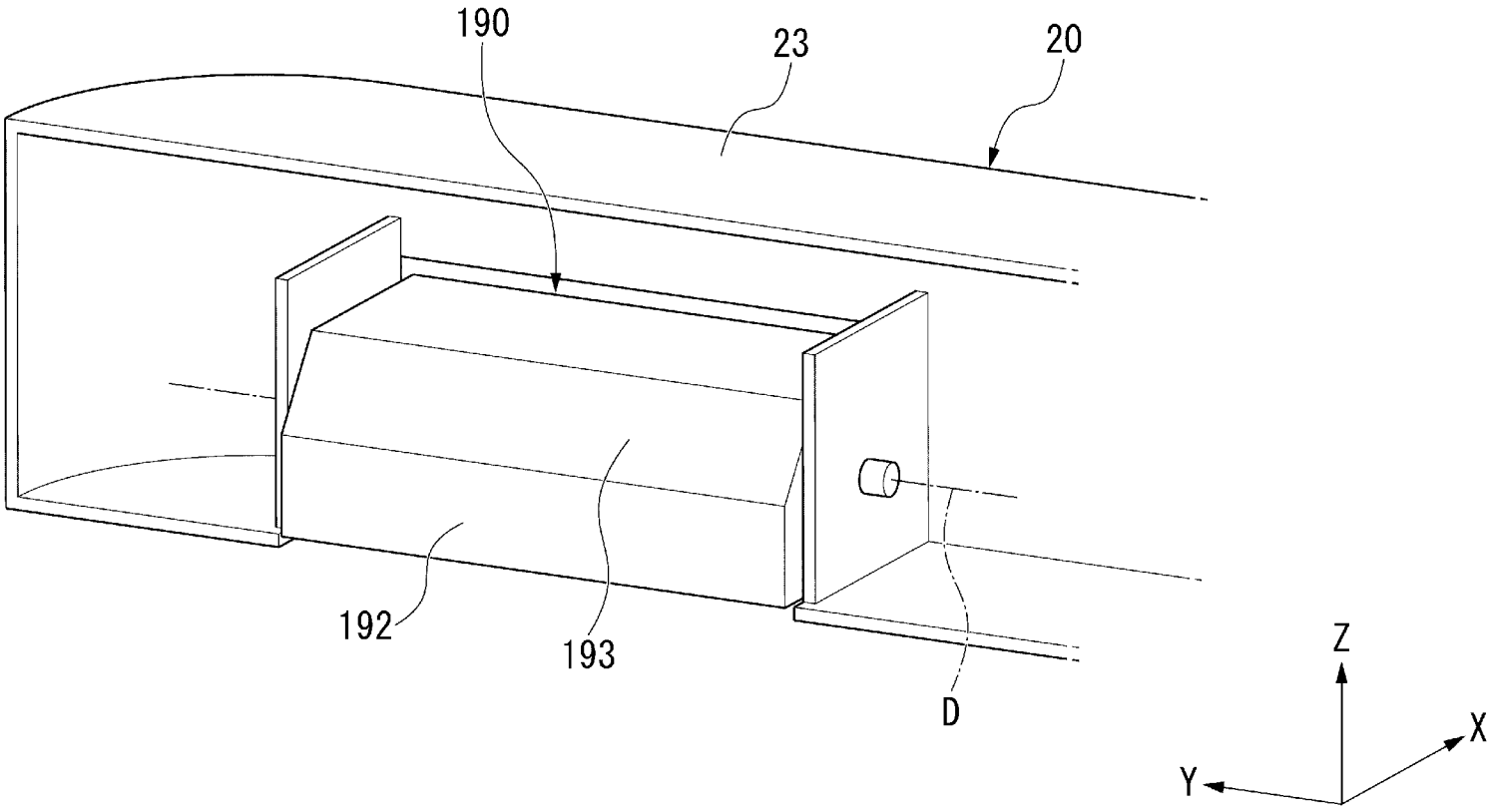
FIG. 12 is a perspective view of the peripheral structure of the restricting member in the image processing apparatus viewed from the depth side.
Figure 13:
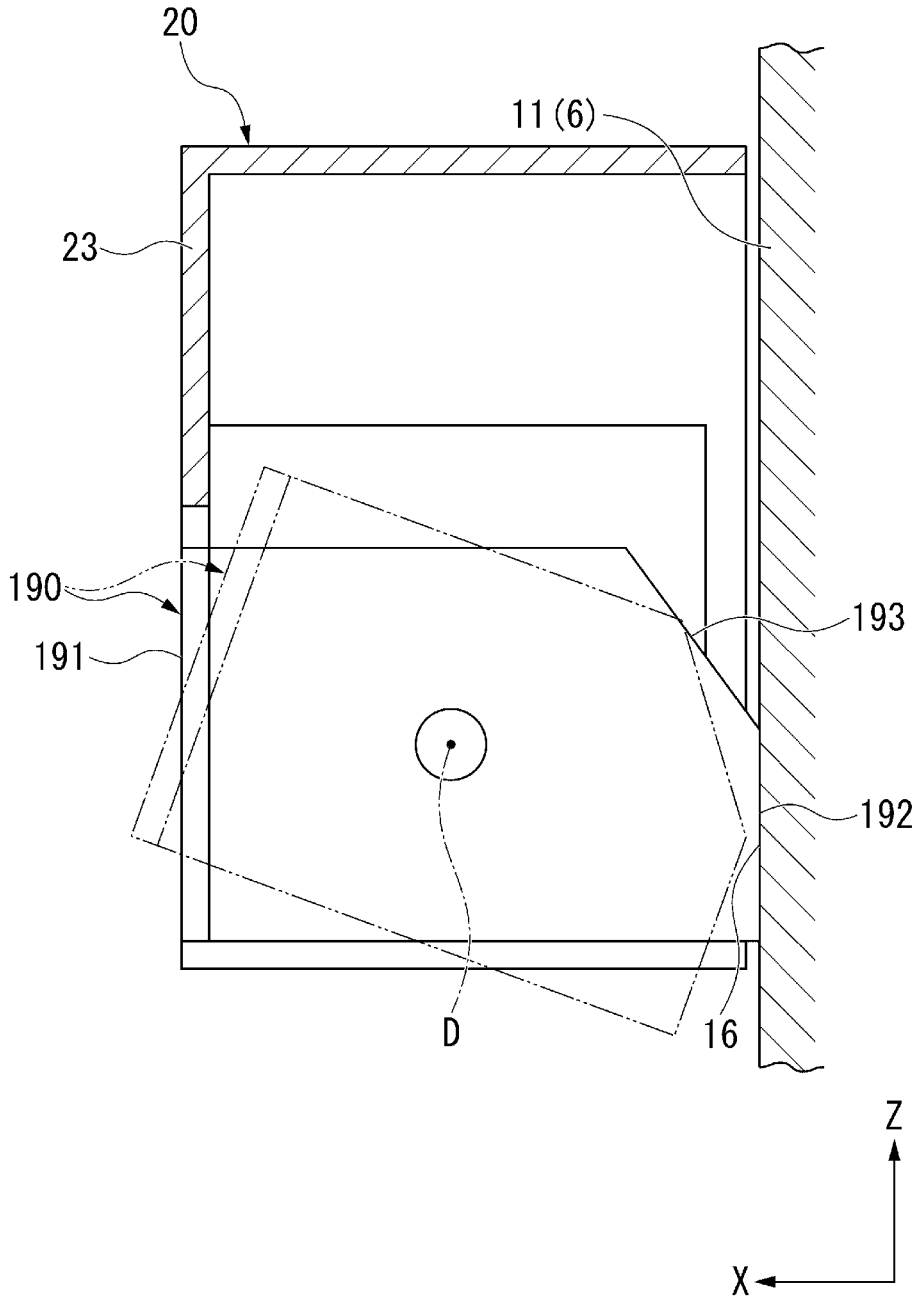
FIG. 13 is a side sectional view illustrating the restricting member and a front cover of a paper feeding cassette in the second embodiment.

A restricting member 190 in a second embodiment is explained with reference to FIGS. 11 to 13. Components other than the components explained below are the same as the components in the first embodiment. FIG. 11 is a perspective view of a peripheral structure of the restricting member 190 in the image processing apparatus 1 in the second embodiment viewed from the near side. FIG. 12 is a perspective view of the peripheral structure of the restricting member 190 in the image processing apparatus 1 in the second embodiment viewed from the depth side. FIG. 13 is a side sectional view illustrating the restricting member 190 and the front cover 23 of the paper feeding cassette 20 in the second embodiment.

The second embodiment is different from the first embodiment in that the restricting member 190 is provided in the paper feeding cassette 20. The restricting member 190 is supported by the front cover 23 of the paper feeding cassette 20 to be relatively displaceable. The restricting member 190 is capable of turning around an axis D extending along the left-right direction. The restricting member 190 is incapable of translating with respect to the paper feeding cassette 20 if viewed from the left-right direction. The restricting member 190 turns between the predetermined position and the allowable position. The predetermined position is indicated by a solid line in FIGS. 11 to 13. The allowable position is indicated by an imaginary line in FIG. 13.

The restricting member 190 includes an operation section 191, a positioning surface 192, and an avoiding section 193. The operation section 191 is provided on the near side of the front cover 23. The operation section 191 is exposed to the near side from the front cover 23. The operation section 191 is a part of a design surface facing the near side in the paper feeding cassette 20. For example, the operation section 191 is flush with a surface facing the near side of the front cover 23.

The positioning surface 192 is a plane facing the depth side. The positioning surface 192 comes into contact with a section to be in contact 16 of the apparatus main body 6 in the predetermined position. For example, the section to be in contact 16 is a part of the front wall 11 of the apparatus main body 6. The restricting member 190 restricts, with contact of the positioning surface 192 and the section to be in contact 16 of the apparatus main body 6, the paper feeding cassette 20 from being displaced to the depth side with respect to the apparatus main body 6.

The avoiding section 193 is adjacent to an upper part of the positioning surface 192. The avoiding section 193 is a plane inclined with respect to the positioning surface 192. The avoiding section 193 is present closer to the axis D than the positioning surface 192 if viewed from the left-right direction. If the restricting member 190 is present in the allowable position, the avoiding section 193 faces the section to be in contact 16 in the depth direction. If the restricting member 190 is present in the allowable position, the avoiding section 193 forms a gap in the depth direction with respect to the section to be in contact 16. The restricting member 190 causes the avoiding section 193 to face the section to be in contact 16 to allow the paper feeding cassette 20 to be displaced to the depth side with respect to the apparatus main body 6.

If the drawing-in mechanism 8 is restored, even if the paper feeding cassette 20 is pushed in to the depth side until the paper feeding cassette 20 is restricted from moving to the depth side by the restricting member 190, the pin member 29 sometimes does not climb over the end portion of the contact surface 58. In this embodiment, for example, the operation section 191 of the restricting member 190 is pushed to turn the restricting member 190 in the clockwise direction from the predetermined position to the allowable position. If the avoiding section 193 faces the section to be in contact 16, the paper feeding cassette 20 is allowed to be displaced to the depth side with respect to the apparatus main body 6. The paper feeding cassette 20 can be further pushed in to the depth side to cause the pin member 29 to climb over the end portion of the contact surface 58.

In this embodiment, the same effects as the effects in the first embodiment are achieved. In addition, since the restricting member 190 is provided in the paper feeding cassette 20, limitation on a setting space for the restricting member 190 can be reduced compared with the case where the restricting member 190 is not provided in the paper feeding cassette 20.

The operation section 191 that displaces the restricting member 190 from the predetermined position to the allowable position is provided on the near side of the paper feeding cassette 20. With this configuration, the restricting member 190 can be easily operated via the operation section 191 compared with the case where the restricting member 190 is operated on the depth side of the paper feeding cassette 20.

Note that the image processing apparatus 1 may include an urging member that urges the restricting member 190 in a direction from the allowable position to the predetermined position. By providing the urging member, the restricting member 190 can be surely returned to the predetermined position. By automatically returning the restricting member 190 to the predetermined position, it is possible to dispose the restricting member 190 in the predetermined position at a normal time without requiring special operation.

The restricting member 190 may not include the operation section 191 provided on the near side of the front cover 23. That is, the entire restricting member 190 may be disposed on the depth side of the front cover 23. In this configuration, the restricting member 190 is operated on the depth side of the front cover 23, for example, in a state in which the paper feeding cassette 20 is drawn out.

The restricting member 190 may not be capable of turning around the axis extending along the left-right direction. For example, the restricting member 190 may be capable of turning around an axis extending along the up-down direction.

The avoiding section 193 may not be adjacent to the upper part of the positioning surface 192. For example, the avoiding section 193 may be adjacent to a lower part of the positioning surface 192. The positioning surface 192 and the avoiding section 193 may not be planes. For example, at least one of the positioning surface 192 and the avoiding section 193 may be a convex curved surface.

Third Embodiment

Figure 14:
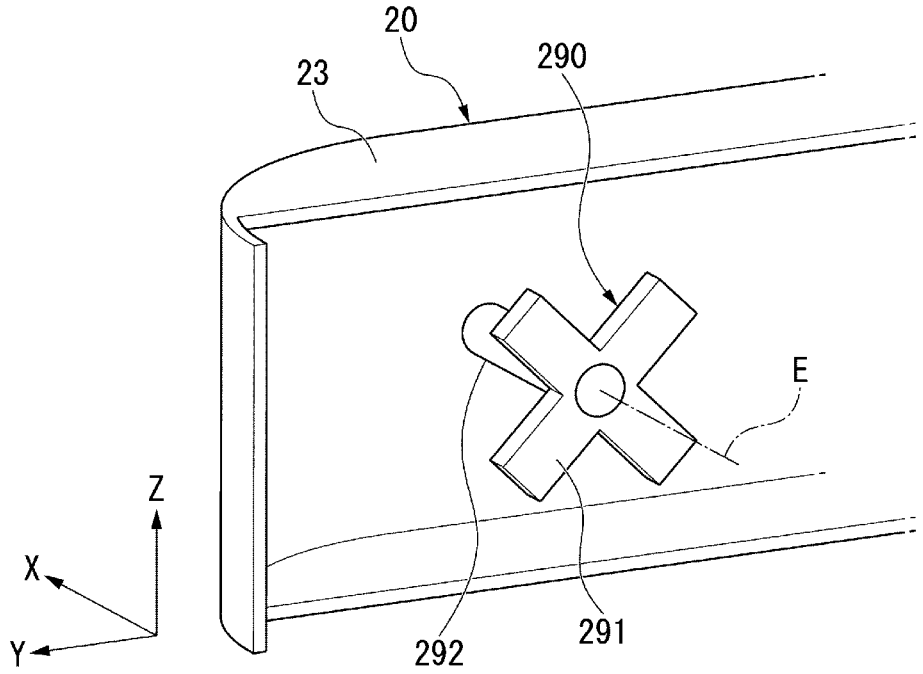
FIG. 14 is a perspective view of a restricting member in the image processing apparatus in a third embodiment viewed from a depth side.
Figure 15:
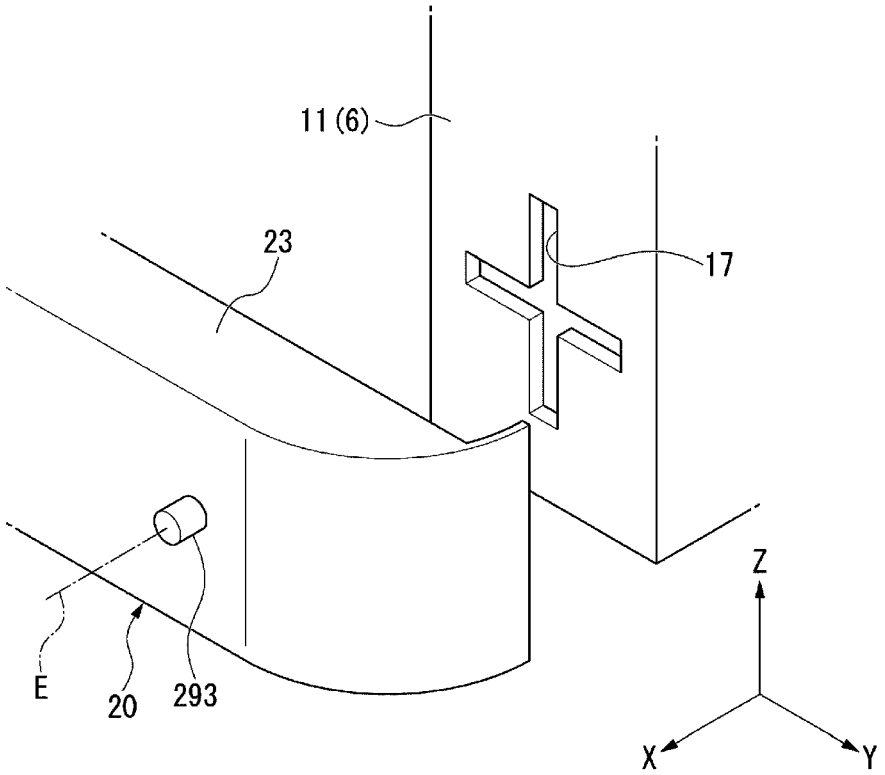
FIG. 15 is a perspective view of a front wall of an apparatus main body in the image processing apparatus.
Figure 16:
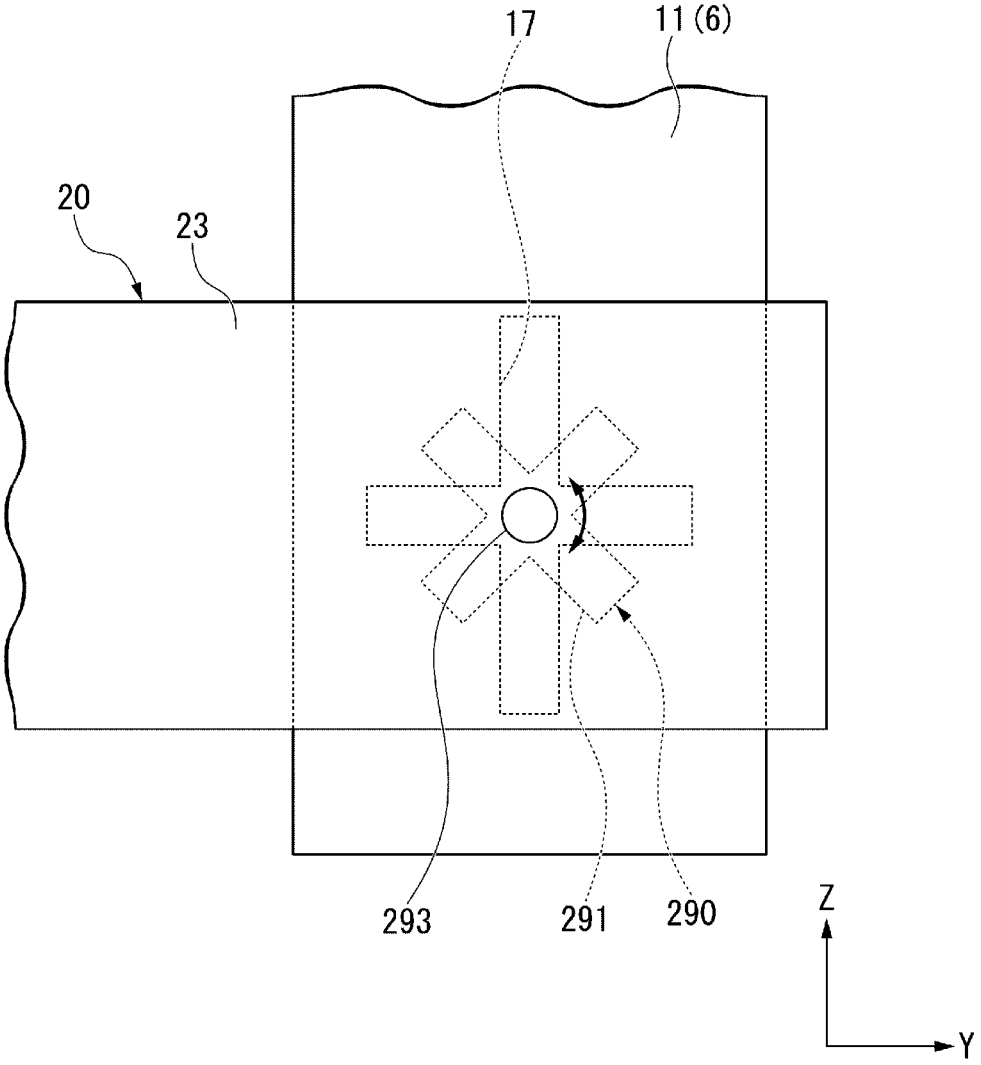
FIG. 16 is a front view illustrating a peripheral structure of the restricting member in the image processing apparatus.

A restricting member 290 in a third embodiment is explained with reference to FIGS. 14 to 16. Components other than components explained below are the same as the components in the first embodiment. FIG. 14 is a perspective view of the restricting member 290 in the image processing apparatus 1 in the third embodiment viewed from the depth side. FIG. 15 is a perspective view of the front wall 11 of the apparatus main body 6 in the image processing apparatus 1 in the third embodiment viewed from the near side. FIG. 16 is a front view illustrating a peripheral structure of the restricting member 290 in the image processing apparatus 1 in the third embodiment.

The third embodiment is different from the first embodiment in that the restricting member 290 is provided in the paper feeding cassette 20. The restricting member 290 is supported by the front cover 23 of the paper feeding cassette 20. The restricting member 290 is incapable of being displaced in the depth direction with respect to the paper feeding cassette 20. The restricting member 290 is capable of turning around an axis E extending in the depth direction with respect to the paper feeding cassette 20. The restricting member 290 turns between the predetermined position and the allowable position.

The restricting member 290 has thickness in the depth direction. A shape of the restricting member 290 viewed from the depth direction is different from a circular shape centering on the axis E. In this embodiment, the restricting member 290 is formed in a cross shape having four arms 291 if viewed from the depth direction. The four arms 291 project in directions inclined with respect to the up-down direction and the left-right direction from the axis E if viewed from the depth direction. If the restricting member 290 is present in the allowable position, the four arms 291 project in the up-down direction and the left-right direction from the axis E if viewed from the depth direction.

A shaft section 292 axially supported by the front cover 23 is coupled to the restricting member 290. The shaft section 292 pierces through the front cover 23 in the depth direction. An operation section 293 is coupled to the end portion on the near side of the shaft section 292. For example, the operation section 293 is a dial. The operation section 293 is disposed on the near side of the front cover 23. The operation section 293 rotates integrally with the restricting member 290.

A recess 17 that receives the restricting member 290 present in the allowable position is formed on the front wall 11 of the apparatus main body 6. A shape of the recess 17 corresponds to a shape of the restricting member 290 present in the allowable position if viewed from the depth direction. The recess 17 is formed in a cross shape in which four grooves project upward and downward and to the left and the right if viewed from the depth direction. If the restricting member 290 is present in the predetermined position, the restricting member 290 comes into contact with a peripheral section of the recess 17 to thereby restrict the paper feeding cassette 20 from being displaced to the depth side with respect to the apparatus main body 6.

In this embodiment, the same effects as the effects in the first embodiment are achieved. In addition, since the restricting member 290 is provided in the paper feeding cassette 20, limitation on a setting space for the restricting member 290 can be reduced compared with the case where the restricting member 290 is not provided in the paper feeding cassette 20.

The operation section 293 that displaces the restricting member 290 from the predetermined position to the allowable position is provided on the near side of the paper feeding cassette 20. With this configuration, the restricting member 290 can be more easily operated via the operation section 293 compared with the case where the restricting member 290 is operated on the depth side of the paper feeding cassette 20.

A shape of the restricting member 290 and a shape of the recess 17 do not need to correspond to each other. The recess 17 only has to be formed in a shape for receiving the restricting member 290 present in the allowable position and restricting entry of the restricting member 290 present in the predetermined position turned from the allowable position.

A drawing-in mechanism is not limited to the configurations in the embodiments. The drawing-in mechanism only has to be connected to a paper feeding cassette and formed to draw the paper feeding cassette into an apparatus main body up to the drawing-in completion position.

According to at least one embodiment explained above, the image processing apparatus includes the restricting member that is displaced from the predetermined position to allow the paper feeding cassette to be displaced to the depth side with respect to the apparatus main body if the paper feeding cassette is not connected to the drawing-in mechanism even if the paper feeding cassette is pushed in to the depth side up to the drawing-in completion position. With this configuration, it is possible to secure a push-in distance necessary for actuating a remedy structure for restoring the drawing-in mechanism by manually pushing in the paper feeding cassette.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An image processing apparatus, comprising:

an apparatus main body;

a paper feeding cassette configured to be inserted into the apparatus main body and drawn out from the apparatus main body in a first orientation along a first direction;

a drawing-in structure connected to the paper feeding cassette and configured to draw the paper feeding cassette into the apparatus main body up to a drawing-in completion position along a second orientation opposite to the first orientation; and a restricting member displaceably interposed between the apparatus main body and the paper feeding cassette in a predetermined position and configured to restrict the paper feeding cassette from a waiting position to the drawing-in completion position in the second orientation, the drawing-in structure configured to restrict further movement of the paper feeding cassette in the completion position and, when the paper feeding cassette is not connected to the drawing-in structure even if the paper feeding cassette is pushed in the second orientation up to the waiting position, displaced from the predetermined position to allow the paper feeding cassette to be displaced in the second orientation with respect to the apparatus main body, wherein the restricting member has an allowable position where the restricting member allows the paper feeding cassette to be displaced in the second orientation with respect to the apparatus main body, and the apparatus further comprises an urging member configured to urge the restricting member in a direction from the allowable position to the predetermined position.

2. The image processing apparatus according to claim 1, wherein the drawing-in structure has a drawing-in completion state in which the drawing-in structure is connectable to the paper feeding cassette present in the drawing-in completion position, the paper feeding cassette includes a pin member projecting in a second direction orthogonal to the first direction, and the drawing-in structure includes:

a cover coupled to the apparatus main body and including a guide groove for guiding the pin member in the first direction;

a lever configured to turn, with respect to the cover, around a main rotation axis extending along the second direction and including, at a distal end portion, a pin engaging section that engages with the pin member, the pin engaging section configured to turn around a sub-rotation axis extending along the second direction and including an engaging groove including a first sidewall that defines the engaging groove from the first orientation and a second sidewall that defines the engaging groove from the second orientation and a contact surface connected to the first sidewall and extending to an opposite side of the second sidewall, the contact surface crossing the guide groove in the drawing-in completion state; and an elastic member configured to apply, to the lever, force for rotating the lever in the second orientation.

3. The image processing apparatus according to claim 2, wherein, when the paper feeding cassette is located on the contact surface in a state in which movement in the second orientation is restricted by the restricting member, the pin member displaces the restricting member from the predetermined position and moves the paper feeding cassette in the second orientation to enter the engaging groove.

4. The image processing apparatus according to claim 1, wherein the restricting member has an allowable position where the restricting member allows the paper feeding cassette to be displaced in the second orientation with respect to the apparatus main body, and the image processing apparatus further comprises a holder configured to movably hold the restricting member and guide the restricting member to move between the predetermined position and the allowable position.

5. The image processing apparatus according to claim 4, wherein the allowable position is present above the predetermined position.

6. The image processing apparatus according to claim 1, wherein the apparatus main body includes a pair of slide sections configured to support both side portions in a width direction in the paper feeding cassette to be movable in the first direction, and the restricting member is disposed on a same side as the drawing-in structure with respect to an intermediate position of the pair of slide sections in the width direction.

7. The image processing apparatus according to claim 1, wherein the restricting member is provided inside the apparatus main body.

8. The image processing apparatus according to claim 1, wherein the restricting member has an allowable position where the restricting member allows the paper feeding cassette to be displaced in the second orientation with respect to the apparatus main body, and the apparatus further comprises an operation section provided in the first orientation of the paper feeding cassette and configured to displace the restricting member from the predetermined position to the allowable position.

* * * * *